US005815059A

United States Patent [19]

Dailey et al.

[11] Patent Number: 5,815,059

[45] Date of Patent: Sep. 29, 1998

[54] COAXIAL ISOLATION MOUNTING OF A TOROIDAL TRANSFORMER

[75] Inventors: George Edward Dailey, McLean; Thomas E. Hatton, Manassas; Rene D. Mock, Mine Run; Frederick Oswald Volles, Manassas, all of Va.

[73] Assignee: Lockheed Martin Corporation, Bethesda, Md.

[21] Appl. No.: 605,832

[22] Filed: Feb. 22, 1996

Related U.S. Application Data

[63] Continuation of Ser. No. 150,573, Nov. 10, 1993, abandoned, which is a continuation of Ser. No. 691,937, Apr. 26, 1991, abandoned.

[51] Int. Cl.[6] ..... H01F 27/06; H01F 27/08; H01F 27/30

[52] U.S. Cl. ..... 336/61; 336/92; 336/100; 336/229

[58] Field of Search ..... 336/100, 174, 336/175, 92, 229, 67, 68, 60, 96, 61

[56] References Cited

U.S. PATENT DOCUMENTS

| | | | |
|---|---|---|---|
| 2,079,697 | 5/1937 | Ranges | 336/92 |
| 2,701,335 | 2/1955 | Sargeant et al. | 336/174 |
| 2,731,606 | 7/1956 | Stewart et al. | 336/100 |
| 2,784,384 | 6/1957 | Vance | 336/100 |
| 2,823,362 | 2/1958 | Geroulo et al. | 336/96 |
| 2,832,012 | 4/1958 | Kleason et al. | 336/92 |
| 3,020,502 | 2/1962 | Graham | 336/92 |
| 3,071,743 | 1/1963 | La Patka et al. | 336/92 |
| 3,125,735 | 3/1964 | Twomey | 336/100 |
| 3,237,137 | 2/1966 | Flaminio | 336/229 |
| 3,243,747 | 3/1966 | Toothman et al. | 336/100 |
| 3,312,920 | 4/1967 | Twomey | 336/100 |
| 3,496,502 | 2/1970 | Moore | 336/59 |
| 3,579,164 | 5/1971 | Rotruck | 336/100 |
| 3,629,757 | 12/1971 | Katayama | 336/100 |
| 4,054,856 | 10/1977 | Linscott, Jr. | 336/174 |
| 4,055,826 | 10/1977 | Franz | 336/100 |
| 4,082,141 | 4/1978 | Perretta | 336/100 |
| 4,318,068 | 3/1982 | Hori | 336/100 |
| 4,335,423 | 6/1982 | Koizumi et al. | 336/183 |
| 4,631,509 | 12/1986 | Arii et al. | 336/92 |
| 4,637,843 | 1/1987 | Takayama et al. | 336/180 |
| 4,694,140 | 9/1987 | Wheeler et al. | 336/229 |
| 4,724,413 | 2/1988 | Kataoka | 336/100 |
| 4,779,068 | 10/1988 | Sakamoto et al. | 336/69 |
| 4,958,134 | 9/1990 | Sawa et al. | 336/229 |

FOREIGN PATENT DOCUMENTS

| | | | |
|---|---|---|---|
| 1040918 | 10/1953 | France | 336/68 |
| 2-288316 | 11/1990 | Japan | 336/92 |

*Primary Examiner*—Thomas J. Kozma
*Attorney, Agent, or Firm*—Calfee, Halter & Griswold LLP

[57] ABSTRACT

A toroidal shaped transformer having two levels of structureborne noise isolation is disclosed. A 30–60 dB reduction in noise is achieved by isolation mounting the toroidal transformers coaxially on a central support rod which in turn is supported by an isolation mounted cradle. The isolation layers are made of compliant elastomeric foam rubber material.

18 Claims, 2 Drawing Sheets

COAXIAL ISOLATION MOUNTING OF A TOROIDAL TRANSFORMER

This is a continuation of application Ser. No. 08/150,573 filed on Nov. 10, 1993, now abandoned which is a continuation of application Ser. No. 07/691,937 filed Apr. 26, 1991, now abandoned.

This invention was made with Government support under Contract Number N00024-88-C-6150 awarded by the Department of the Navy. The Government has certain rights in this invention.

BACKGROUND OF THE INVENTION

1. Technical Field

The invention disclosed broadly relates to vibration dampening of power transformers and more particularly relates to a coaxial isolation mounting for a toroidal transformer.

2. Background Art

It is well-known that the magnetic core is a source of sound in an electrical transformer. Energization of the electrical windings surrounding a magnetic core results in alternating magnetization of the core, and the core laminations cyclically expand and contract due to the phenomena of magnetostriction when magnetized and demagnetized by the current flowing in the transformer windings. The magnetic core thus acts as a source of 120 cycle per second vibrations and harmonics thereof. The vibrations generated by the magnetic core together with the weight of the core and core assembly may force the rigid base structure beneath a transformer casing into vibration. The casing sidewalls are rigidly connected to the base structure and may be driven into vibration by the stiff base members and propagate noise. When the rigid base structure is resonant at 120 cycles or harmonics thereof, the propagating noise level may be even more pronounced.

High structure-borne noise levels are undesirable because they add to the acoustic signature in the low noise environments needed in such applications as submarines.

SUMMARY OF THE INVENTION

It is an object of the present invention to provide a high efficiency compact design power transformer having low acoustic signature.

Toroidal shaped transformers are compact and inherently quieter than standard core configured transformers. To significantly reduce the structure-borne noise being transmitted out of a transformer package, toroidal shaped coils are isolation mounted on a coaxial rod running through the center of the coil. The coaxial rod is supported at its ends by a cradle which rests on a layer of vibration isolation material. The isolation layers are made of compliant, flexible elastomeric foam material. Use of the center space in the toroid for the isolation mounting makes use of otherwise unused volume and allows two levels of vibration isolation where only one level of isolation at the outside of the toroid, would have been previously used.

The coaxial center support rod minimizes any noise coupling between a plurality of toroids. The outer portions of the toroidal coil are unsupported and thus isolated from the transformer mounting plate or case. The result is very low levels of structure-borne noise being transmitted out of the case.

BRIEF DESCRIPTION OF THE DRAWINGS

These and other objects, features and advantages will be more fully appreciated with reference to the accompanying figures.

DETAILED DESCRIPTION OF THE INVENTION

Figure 1A:
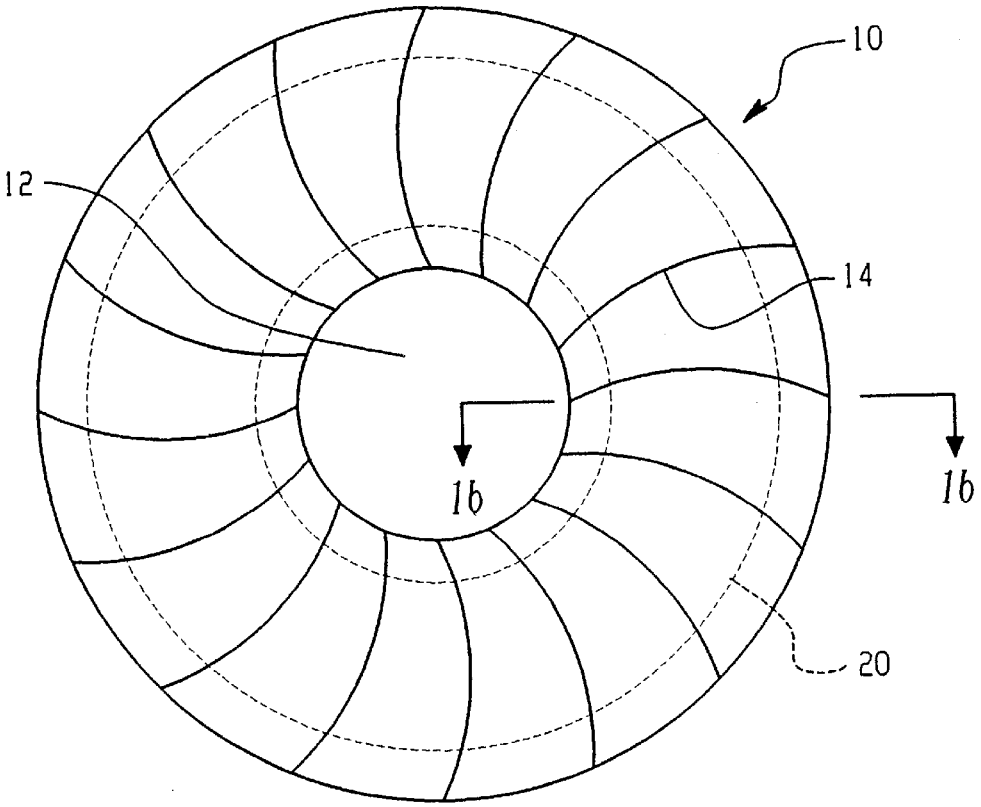
FIG. 1A is a typical toroidal transformer and FIG. 1B is a cross-section taken along the lines AA of FIG. 1A.

Toroidal shaped transformers provide high power density for their volumetric size. Additionally, toroidal transformers are inherently quieter than standard core configured transformers. As seen in FIG. 1A, a typical toroidal shaped transformer 10 has an outer circumference and an inner space 12 filling the inner diameter of the transformer or windings 14.

Figure 1B:
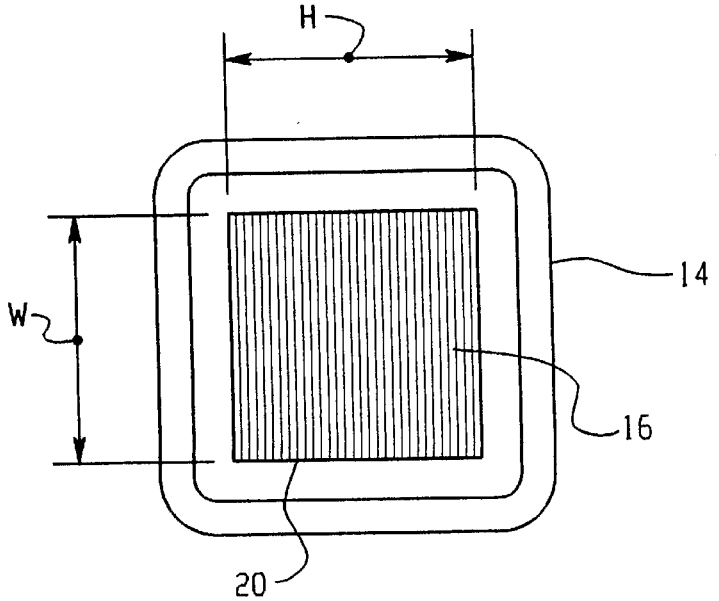

A cross-sectional view of the toroidal transformer is shown in FIG. 1B. As can be seen, the core is made from continuous steel tape 16 wound to height H, having a strip width W. Surrounding the core 20 is a series of windings 14. Each layer of steel tape 16 is in the order of two to three mils in thickness and is wrapped to be in tight union with each adjacent turn. As the core is held under compression during the winding process, toroidal transformers are inherently quieter than a planar core configured transformer, or core comprised of stacked laminations. The circular shape provides high power density for the volume of the transformer.

Figure 2:
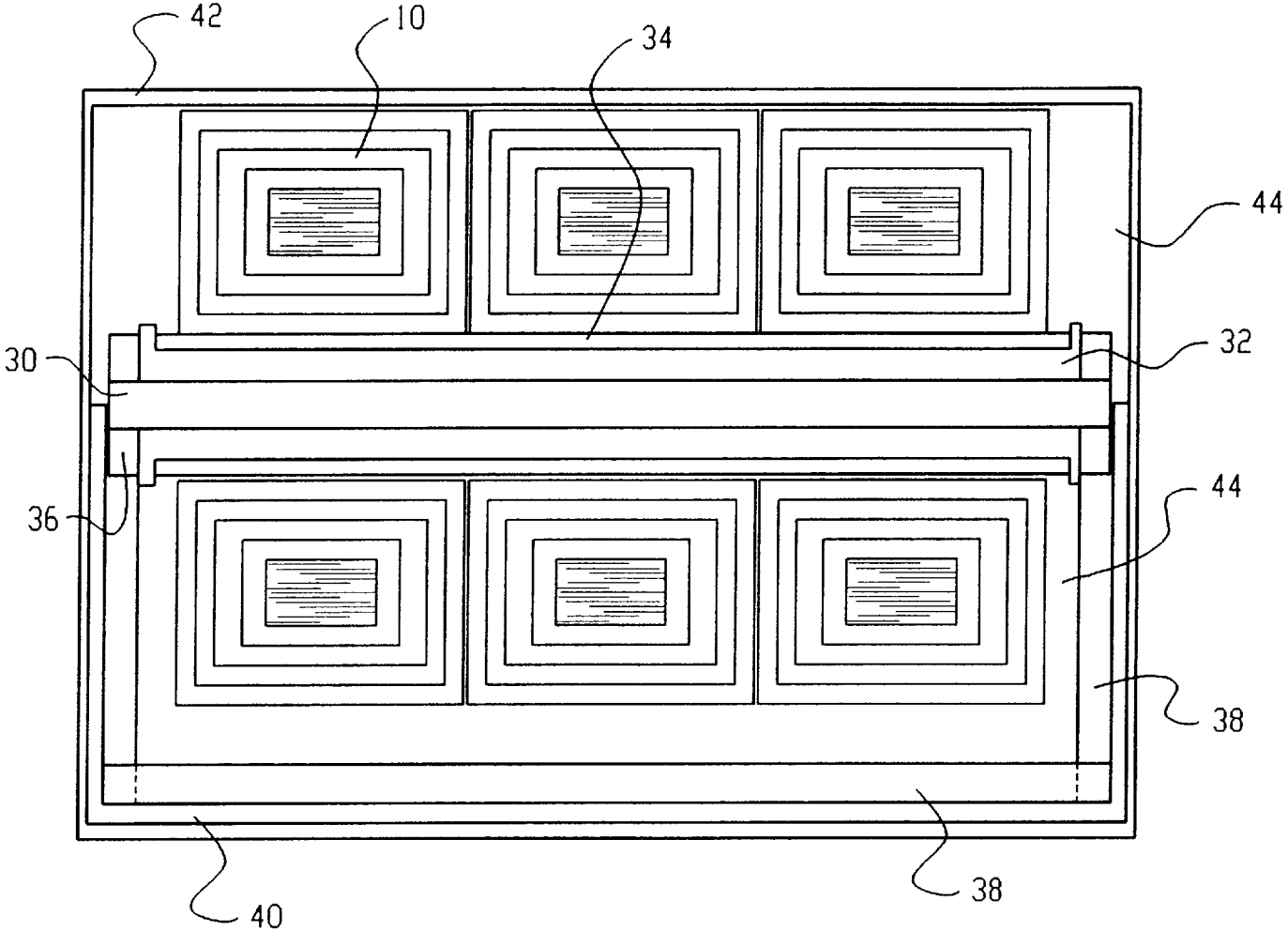
FIG. 2 is a plane view of the present invention showing three toroidal transformers isolation mounted in a case.

The present invention is shown in FIG. 2 having three toroidal transformers 10 suspended on a support rod 30. The support rod can be made of stainless steel or other material. The unused central volume 12 of the transformers is filled with an isolation material 32 which can be a silicone closed cell rubber material. A cooling sleeve 34 is placed adjacent the inner diameter of the toroidal transformer for heat removal. Each end of the support rod 30 is supported by an isolation washer 36. Isolation washer 36 is non-conductive and provides electrical isolation between the support rod and the case eliminating the possibility of a shorted turn. The isolation washers are made of dielectric material such as phenolic or glass epoxy. The isolation washers 36 are supported by cradle 38 which supports the toroidal transformers. The stainless steel cradle 38 is mounted on an isolation layer 40 which provides a second level of structure-borne noise isolation between the toroidal transformer and mounting case 42. An air space 44 surrounds the toroids 10, so they do not touch the case 42 or cradle 38 to cause noise shorts.

By employing a two level isolation mounting, the acoustic signature of the transformer is reduced by a factor of 30 to 60 dB related to 10 um/sec$^2$ from the non-isolated transformer. The 120 cycle per second noise level is greatly reduced and various harmonics are virtually eliminated.

The transformer mounting scheme as disclosed allows for various power size configuration to be made by using a plurality of similar size toroid transformers to be mounted on a cradle by simply adjusting its length to accommodate more toroidal transformers or by scaling up or down the size of the transformers used. The core induced heat generated during the use of the transformer can be readily removed by the cooling sleeve 34 integrated into the system as shown.

Although a specific embodiment of the invention has been disclosed, it will be understood by those having skill in the art that changes can be made to the specific embodiment without departing from the spirit and scope of the invention.

What is claimed is:

1. A low noise power transformer unit comprising:

a mounting case;

a cradle positioned within said mounting case and supported by said mounting case, said cradle having a first support arm on one side thereof and a second support arm on another side thereof;

a layer of vibration isolating material interposed between said cradle and said mounting case to provide a first level of vibration isolation within said power transformer unit;

a longitudinal support rod positioned within said mounting case and including first and second opposing ends, the first supporting arm of said cradle supporting said first opposing end of said support rod within said mounting case and the second supporting arm of said cradle supporting the second opposing end of said support rod within said mounting case so that the weight of said support rod is carried by said first and second supporting arms;

at least one toroidal-shaped transformer coaxially positioned about said support rod within said mounting case;

a second layer of vibration isolating material interposed between said support rod and said toroidal-shaped transformer to provide a second level of vibration isolation within said power transformer unit; and a cooling sleeve positioned within said mounting case and substantially about both said second layer of vibration isolating material and said support rod and between said second layer of vibration isolating material and the inner surface of said transformer.

2. The unit of claim 1 wherein said mounting case includes a plurality of sides, the external surfaces of said toroidal-shaped transformer not directly touching the internal surfaces of said sides, and further wherein said support rod is horizontally disposed in said mounting case.

3. The unit of claim 2 wherein said toroidal-shaped transformer does not also directly touch said cradle.

4. The unit of claim 1 wherein the number of toroidal-shaped transformers within said mounting case is greater than two, said transformers being positioned within said mounting case and coaxially about said support rod in a side-by-side orientation.

5. The unit of claim 1 further including first and second washers located about said first and second ends of said support rod, respectively, and supported by said cradle, said washers providing electrical insulation between said support rod and said mounting case.

6. The unit of claim 5 wherein said washers are comprised of dielectric material selected from the group consisting of phenolics and glass epoxies.

7. The unit of claim 1 wherein said support rod and said cradle are comprised of metallic material.

8. The unit of claim 7 wherein said metallic material is stainless steel.

9. The unit of claim 1 wherein said vibration isolating material is comprised of an elastomeric polymer.

10. The unit of claim 1 wherein said cooling sleeve is further coaxial with said longitudinal support rod.

11. The unit of claim 1 wherein said cooling sleeve is in physical communication with said at least one toroidal-shaped transformer.

12. The unit of claim 1 wherein said cooling sleeve is further interposed between said second isolation layer and said at least one toroidal-shaped transformer.

13. The unit of claim 12 wherein said cooling sleeve is further in physical communication with said second isolation layer and said at least one toroid-shaped transformer.

14. A transformer assembly for dampening the vibrational noise caused at least one transformer, the assembly comprising:

(a) at least one toroidal transformer; the transformer having an inner surface and an inner space;

(b) a housing having an inner space for housing the at least one transformer;

(c) a transformer support member for holding the at least one transformer; the support member comprising opposite first and second ends and wherein the support member is positioned through the inner space of the at least one transformer;

(d) a cradle having first and second cradle support members for providing support for the transformer support member;

(e) a first layer of vibrational isolating material interposed between the cradle and the housing to provide a first level of vibrational isolation within the transformer assembly;

(f) a second layer of vibrational isolating material interposed between the transformer support member and the at least one transformer to provide a second level of vibrational isolation within the transformer assembly; and (g) a cooling sleeve positioned within the housing and substantially about both the second layer of vibration isolating material and the transformer support member and between said second layer of vibration isolating material and the inner surface of the at least one transformer.

15. The unit of claim 14 wherein the cooling sleeve is further coaxial with the transformer support member.

16. The unit of claim 14 wherein the cooling sleeve is in physical communication with the at least one transformer.

17. The unit of claim 14 wherein the cooling sleeve is further in interposed between the second isolation layer and the at least one transformer.

18. The unit of claim 17 wherein the cooling sleeve is further in physical communication with the second isolation layer and the at least one transformer.

* * * * *